US010156122B2

(12) United States Patent
Nguyen et al.

(10) Patent No.: US 10,156,122 B2
(45) **Date of Patent: *Dec. 18, 2018**

(54) BACK PRESSURE VALVE

(71) Applicant: Cameron International Corporation, Houston, TX (US)

(72) Inventors: Dennis P. Nguyen, Pearland, TX (US); Kirk P. Guidry, Houston, TX (US); Thomas E. Taylor, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/662,228

(22) Filed: Jul. 27, 2017

(65) Prior Publication Data

US 2018/0106128 A1 Apr. 19, 2018

Related U.S. Application Data

(63) Continuation of application No. 15/071,201, filed on Mar. 15, 2016, now Pat. No. 9,719,323, which is a (Continued)

(51) Int. Cl.
*E21B 34/02* (2006.01)
*E21B 34/00* (2006.01)

(Continued)

(52) U.S. Cl.
CPC ..... *E21B 34/02* (2013.01); *E21B 23/00* (2013.01); *E21B 23/02* (2013.01); *E21B 33/04* (2013.01); *E21B 33/1208* (2013.01); *E21B 34/00* (2013.01)

(58) Field of Classification Search
CPC ..... E21B 34/02; E21B 23/00; E21B 23/02; E21B 34/00; E21B 33/1208; E21B 33/04
See application file for complete search history.

(56) References Cited

U.S. PATENT DOCUMENTS 2,358,677 A 9/1944 Yancey
2,582,700 A 1/1952 Jones (Continued)

FOREIGN PATENT DOCUMENTS

EP 0370744 A1 5/1990
GB 2291449 A 1/1996

(Continued)

OTHER PUBLICATIONS

SG Written Opinion; Application No. SG 201003105-2; dated Mar. 2, 2011; 5 pages.

(Continued)

*Primary Examiner* — Yong-Suk Ro
(74) *Attorney, Agent, or Firm* — Fletcher Yoder, P.C.

(57) ABSTRACT

A system includes a back pressure valve configured to mount in a mineral extraction system. The back pressure valve comprises a cylindrical body comprising a venting port coaxial with a longitudinal axis of the cylindrical body and a plunger disposed in the venting port, wherein the plunger comprises a stem that extends from the venting port into an adjacent cavity of the cylindrical body. A method of operating a valve, includes biasing a plunger to an open position, biasing a valve locking mechanism to a locked position in relation to a bore of a mineral extraction system, and biasing a plunger to a closed position.

22 Claims, 8 Drawing Sheets

Related U.S. Application Data continuation of application No. 13/975,306, filed on Aug. 24, 2013, now Pat. No. 9,297,226, which is a continuation of application No. 12/741,188, filed as application No. PCT/US2008/079243 on Oct. 8, 2008, now Pat. No. 8,616,289.

(60) Provisional application No. 60/989,647, filed on Nov. 21, 2007.

(51) Int. Cl.

| | |
|---|---|
| ***E21B 33/12*** | (2006.01) |
| ***E21B 23/02*** | (2006.01) |
| ***E21B 23/00*** | (2006.01) |
| ***E21B 33/04*** | (2006.01) |

(56) References Cited

U.S. PATENT DOCUMENTS

| | | | | |
|---|---|---|---|---|
| 3,115,933 | A | 12/1963 | Haeber | |
| 3,193,308 | A | 7/1965 | Todd | |
| 3,209,829 | A | 10/1965 | Haeber | |
| 3,250,331 | A * | 5/1966 | Boyle | E21B 23/02 166/133 |
| 3,287,030 | A | 11/1966 | Crain et al. | |
| 3,351,133 | A | 11/1967 | Clark, Jr. et al. | |
| 3,376,935 | A | 4/1968 | Baker | |
| 3,385,370 | A | 5/1968 | Knox et al. | |
| 3,542,125 | A | 11/1970 | Sizer | |
| 3,913,670 | A | 10/1975 | Ahlstone | |
| 3,924,679 | A | 12/1975 | Jansen, Jr. | |
| 3,933,202 | A | 1/1976 | Ahlstone | |
| 4,003,434 | A | 1/1977 | Garrett et al. | |
| 4,058,162 | A | 11/1977 | Smith | |
| 4,121,660 | A | 10/1978 | Koleilat | |
| 4,164,977 | A * | 8/1979 | Arendt | E21B 23/02 166/125 |
| 4,381,868 | A | 5/1983 | Croy et al. | |
| 4,657,083 | A | 4/1987 | Ringgenberg | |
| 4,667,986 | A | 5/1987 | Johnson et al. | |
| 4,736,799 | A | 4/1988 | Ahlstone | |
| 4,745,974 | A * | 5/1988 | Higgins | E21B 34/105 166/125 |
| 4,790,379 | A | 12/1988 | Vanderford, Jr. | |
| 4,791,992 | A | 12/1988 | Greenlee et al. | |
| 4,825,945 | A | 5/1989 | Smith | |
| 4,848,469 | A | 7/1989 | Baugh et al. | |
| 5,013,187 | A | 5/1991 | MacIntyre et al. | |
| 5,114,158 | A | 5/1992 | Le | |
| 5,174,376 | A | 12/1992 | Singeetham | |
| 5,320,181 | A * | 6/1994 | Lantier, Sr. | E21B 21/10 166/325 |
| 5,456,321 | A | 10/1995 | Shiach et al. | |
| 5,511,617 | A | 4/1996 | Snider et al. | |
| 5,542,475 | A * | 8/1996 | Turner | E21B 23/02 166/115 |
| 5,782,297 | A | 7/1998 | Samuels et al. | |
| 5,909,769 | A | 6/1999 | Duhon | |
| 5,988,282 | A | 11/1999 | Jennings et al. | |
| 5,996,695 | A | 12/1999 | Koleilat et al. | |
| 6,059,339 | A | 5/2000 | Madson | |
| 6,260,850 | B1 | 7/2001 | Beall et al. | |
| 6,283,477 | B1 | 9/2001 | Beall et al. | |
| 6,349,771 | B1 | 2/2002 | Luke | |
| 6,497,291 | B1 | 12/2002 | Szarka | |
| 6,585,048 | B1 | 7/2003 | Heijnen | |
| 6,622,795 | B2 | 9/2003 | Hebert et al. | |
| 6,834,726 | B2 | 12/2004 | Giroux et al. | |
| 6,969,070 | B2 | 11/2005 | Reimert et al. | |
| 6,988,556 | B2 | 1/2006 | Vick, Jr. | |
| 7,069,987 | B2 | 7/2006 | Kwasniewski et al. | |
| 7,111,688 | B2 | 9/2006 | Van Bilderbeek | |
| 7,128,143 | B2 | 10/2006 | Van Bilderbeek | |
| 7,137,453 | B2 | 11/2006 | Gustafson et al. | |
| 7,240,735 | B2 | 7/2007 | Crozier | |
| 7,308,934 | B2 | 12/2007 | Swagerty et al. | |
| 7,527,104 | B2 | 5/2009 | Branch et al. | |
| 7,886,831 | B2 * | 2/2011 | Butterfield, Jr. | E21B 43/105 166/177.4 |
| 9,297,226 | B2 | 3/2016 | Nguyen et al. | |
| 2002/0023758 | A1 | 2/2002 | George et al. | |
| 2002/0100592 | A1 | 8/2002 | Garrett et al. | |
| 2004/0055757 | A1 * | 3/2004 | Beall | E21B 23/02 166/382 |
| 2006/0108119 | A1 | 5/2006 | Bailey et al. | |
| 2007/0039738 | A1 | 2/2007 | Fenton et al. | |
| 2007/0079990 | A1 | 4/2007 | Borak | |
| 2009/0090515 | A1 | 4/2009 | Chan et al. | |
| 2010/0051261 | A1 | 3/2010 | Koleilat et al. | |
| 2010/0193195 | A1 | 8/2010 | Nguyen et al. | |
| 2010/0258319 | A1 | 10/2010 | Nguyen et al. | |
| 2011/0011575 | A1 | 1/2011 | Nguyen et al. | |

FOREIGN PATENT DOCUMENTS

| | | | |
|---|---|---|---|
| GB | 2408989 | A | 6/2005 |
| WO | 02/38913 | A1 | 5/2002 |
| WO | 2009/014795 | A2 | 1/2009 |

OTHER PUBLICATIONS

PCT International Search Report and Written Opinion; Application No. PCTUS2008/079243, dated Jan. 30, 2009; 13 pages.

* cited by examiner

BACK PRESSURE VALVE

CROSS REFERENCE TO RELATED APPLICATIONS

This application is a continuation of U.S. Non-Provisional patent application Ser. No. 15/071,201, entitled "Back Pressure Valve," filed Mar. 15, 2016, now U.S. Pat. No. 9,719,323, issuing on Aug. 1, 2017, which is herein incorporated by reference in its entirety, and which is a continuation of U.S. Non-Provisional patent application Ser. No. 13/975,306, entitled "Back Pressure Valve," filed Aug. 24, 2013, now U.S. Pat. No. 9,297,226, issued on Mar. 29, 2016, which is herein incorporated by reference in its entirety, and which is a continuation of U.S. Non-Provisional patent application Ser. No. 12/741,188, entitled "Back Pressure Valve," filed May 3, 2010, now U.S. Pat. No. 8,616,289, issued on Dec. 31, 2013, which is herein incorporated by reference in its entirety, and which is a National Stage of PCT Patent Application No. PCT/US2008/079243, entitled "Back Pressure Valve," filed Oct. 8, 2008, which is herein incorporated by reference in its entirety, and which claims priority to and benefit of U.S. Provisional Patent Application No. 60/989,647, entitled "Back Pressure Valve", filed on Nov. 21, 2007, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly that is used to extract the resource. These wellhead assemblies include a wide variety of components and/or conduits, such as various control lines, casings, valves, and the like, that are conducive to drilling and/or extraction operations. In drilling and extraction operations, in addition to wellheads, various components and tools are employed to provide for drilling, completion, and the production of mineral resources. For instance, during drilling and extraction operations seals and valves are often employed to regulate pressures and/or fluid flow.

A wellhead system often includes a tubing hanger or casing hanger that is disposed within the wellhead assembly and configured to secure tubing and casing suspended in the well bore. In addition, the hanger generally regulates pressures and provides a path for hydraulic control fluid, chemical injections, or the like to be passed through the wellhead and into the well bore. In such a system, a back pressure valve is often disposed in a central bore of the hanger. The back pressure valve plugs the central bore of the hanger to block pressures of the well bore from manifesting through the wellhead. During some operations, the back pressure valve is removed to provide access to regions below the hanger, such as the well bore.

Typically, the back pressure valve is provided separately from the hanger, and is installed after the hanger has been landed in the wellhead assembly. In other words, the hanger is run down to the wellhead, followed by the installation of the back pressure valve. One challenge includes installing the back pressure valve into the hanger bore in context of high pressures in the bore. Accordingly, installation of the back pressure valve may include the use of several tools and a sequence of procedures to set and lock the seal. Unfortunately, each of the sequential running procedures may consume a significant amount of time and cost. For example, each run of a tool may take several hours, which can translate into a significant cost when operating a mineral extraction system. Further, the use of multiple tools may introduce increased complexity and cost.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
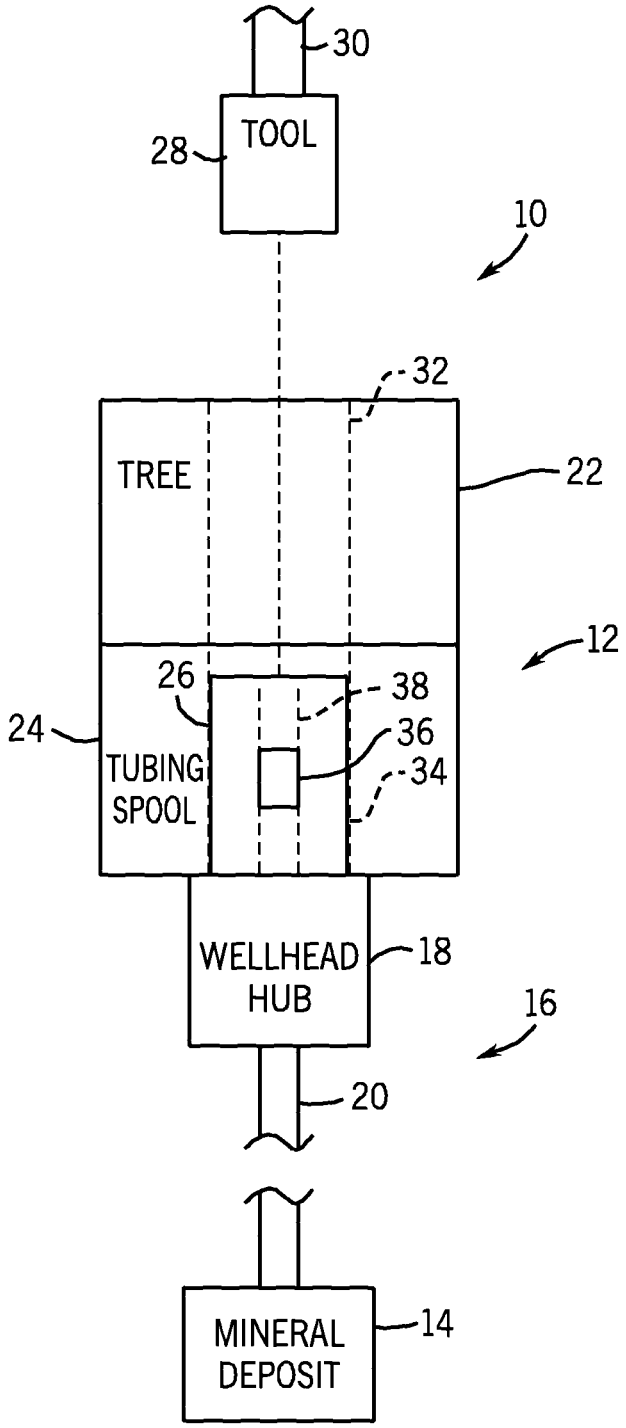
FIG. 1 is a block diagram that illustrates a mineral extraction system in accordance with an embodiment of the present technique.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present technique include a system and method that addresses one or more of the above-mentioned inadequacies of conventional sealing systems and methods. As explained in greater detail below, the disclosed embodiments include a back pressure valve that can be installed into mineral extraction system in a single trip, with a single tool. More specifically, the back pressure valve is installed via a weight/load applied to the back pressure valve. In certain embodiments, the back pressure valve includes a cylindrical body having a venting port that provides a path through the body. A plunger is disposed in the venting port to open and close the venting port. In certain embodiments, the plunger is biased to a closed position. In other embodiments, the plunger includes a stem that extends from the venting port, wherein the stem can be depressed to open the venting port. Opening the venting port may enable pressure to equalize on either side of the back pressure valve. Embodiments of the back pressure valve also include a locking mechanism that couples the back pressure valve to a bore of a mineral extraction system. In certain embodiments, a back pressure valve running tool includes a body and a plunger that interfaces with portions of the back pressure valve. In some embodiments, the body of the tool engages the back pressure valve to lock the back pressure valve into the bore. Further, in certain embodiments, the plunger of the tool engages the plunger of the back pressure valve to bias the plunger to an open position. After the back pressure valve is locked in position, the running tool can be retrieved, leaving the back pressure valve in a locked position and enabling the plunger to return to a closed position. In another embodiment, a retrieval tool can be employed to bias the plunger to an open position, unlock the back pressure valve, and extract the back pressure valve from the bore.

FIG. 1 is a block diagram that illustrates a mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well bore 20. The wellhead hub 18 provides for the connection of the wellhead 12 to the well 16. For example, the wellhead 12 includes a connector that is coupled to a complementary connector of the wellhead hub 18. In one embodiment, the wellhead hub 18 includes a DWHC (Deep Water High Capacity) hub manufactured by Cameron, headquartered in Houston, Tex., and the wellhead 12 includes a complementary collet connector (e.g., a DWHC connector), also manufactured by Cameron.

The wellhead 12 typically includes multiple components that control and regulate activities and conditions associated with the well 16. For example, the wellhead 12 generally includes bodies, valves and seals that route produced minerals from the mineral deposit 14, provide for regulating pressure in the well 16, and provide for the injection of chemicals into the well bore 20 (down-hole). In the illustrated embodiment, the wellhead 12 includes what is colloquially referred to as a christmas tree 22 (hereinafter, a tree), a tubing spool 24, and a hanger 26 (e.g., a tubing hanger or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools (e.g., the hanger 26) into the well 16, the injection of various chemicals into the well 16 (down-hole), and the like. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities.

The tubing spool 24 provides a base for the wellhead 24 and/or an intermediate connection between the wellhead hub 18 and the tree 22. Typically, the tubing spool 24 is one of many components in a modular subsea or surface mineral extraction system 10 that is run from an offshore vessel or surface system. The tubing spool 24 includes the tubing spool bore 34. The tubing spool bore 34 connects (e.g., enables fluid communication between) the tree bore 32 and the well 16. Thus, the tubing spool bore 34 may provide access to the well bore 20 for various completion and worker procedures. For example, components can be run down to the wellhead 12 and disposed in the tubing spool bore 34 to seal-off the well bore 20, to inject chemicals down-hole, to suspend tools down-hole, to retrieve tools down-hole, and the like.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as seals, plugs and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and the like. The hanger 26 includes a hanger bore 38 that extends through the center of the hanger 26, and that is in fluid communication with the tubing spool bore 34 and the well bore 20. Unfortunately, pressures in the bores 20 and 34 may manifest through the wellhead 12 if not regulated. A back pressure valve 36 is often seated and locked in the hanger bore 38 to regulate the pressure. Similar back pressure valves 36 may be used throughout mineral extraction systems 10 to regulate fluid pressures and flows.

In the context of the hanger 26, the back pressure valve 36 can be installed into the hanger 26 before the hanger 26 is installed in the wellhead 12, or may be installed into the hanger 26 after the hanger 26 has been installed in the wellhead 12 (e.g., landed in the tubing spool bore 34). In the latter case, the hanger 26 may be run down and installed into the subsea wellhead 12, followed by the installation of the back pressure valve 36. However, during installation of the back pressure valve 36, pressure from the well bore 20 may exert a force (e.g., a backpressure) on the lower portion of the back pressure valve 36. Unfortunately, the backpressure may make installation of the back pressure valve 36 difficult. For example, backpressure may resist the installation of the back pressure valve 36, and, as a result, installation of the back pressure valve 36 may involve a significant amount of time and cost. Further, multiple tools may be employed, wherein the tools increase the complexity and cost of the system 10. For example, one or more hydraulically operated tools may be employed to lock a valve in place. The following embodiments discuss systems and methods that reduce the complexity and cost while improving the safety related to running, seating, and locking the back pressure valve 36 in the mineral extraction system 10. The systems and methods rely on axial loading to weight-set the back pressure valve 36, and do not employ rotation of a tool or the back pressure valve 36 to run, seat or lock the back pressure valve 36.

Figure 2:
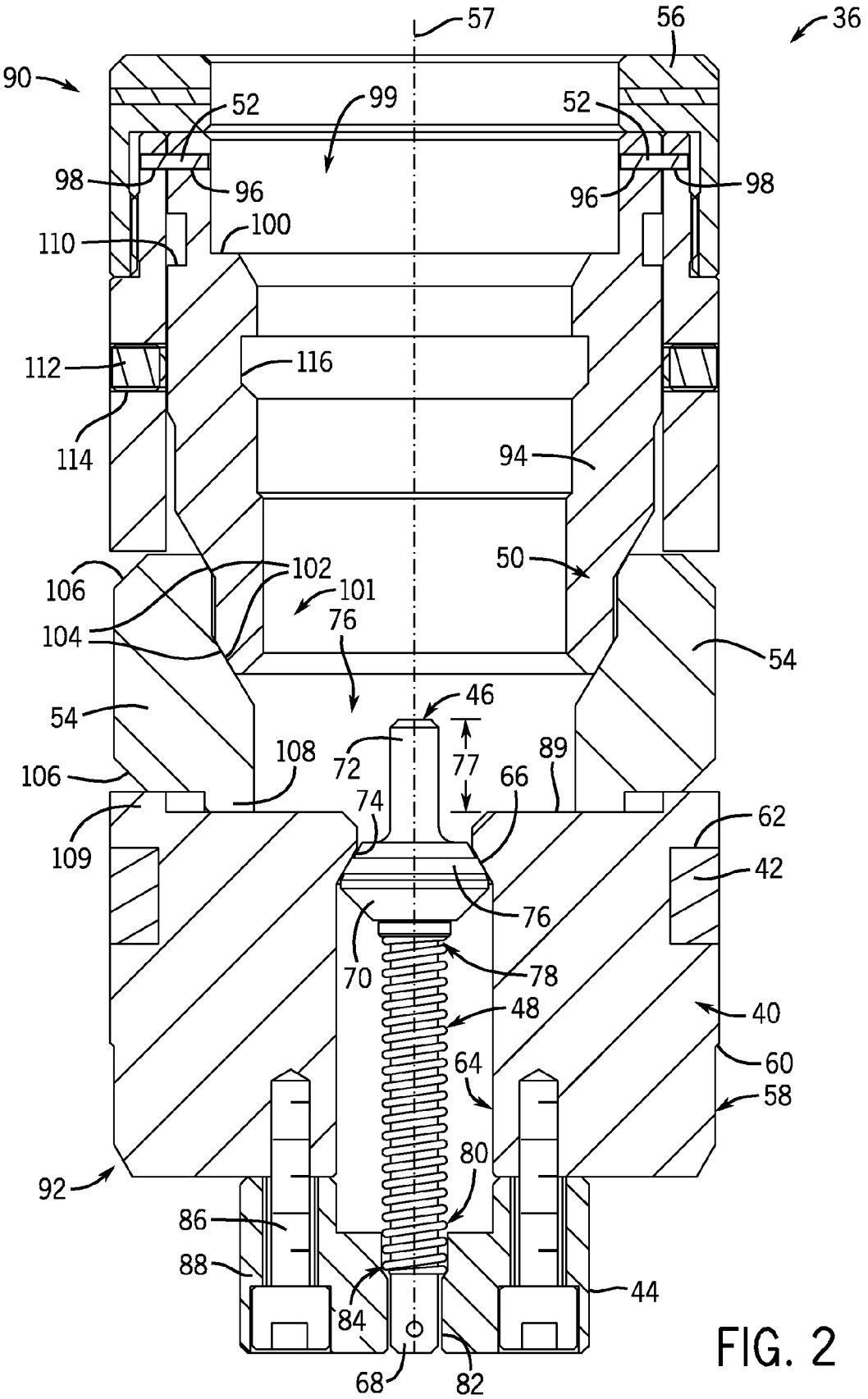
FIG. 2 illustrates an embodiment of a back pressure valve in an unlocked position.

FIG. 2 illustrates a cross section of an exemplary embodiment of the back pressure valve 36. In the illustrated embodiment, the back pressure valve 36 includes a body 40, a body seal 42, a bottom hold-down ring 44, a plunger 46, a plunger spring 48, a hold down sleeve 50, sleeve shear pins 52, lock segments 54, and an upper hold down ring 56.

The body 40 generally includes a shape that is similar to the contour of the hanger bore 38. In the illustrated embodiment, the body 40 includes a cylindrical shape about a longitudinal axis 57, wherein the outer diameter of the body 40 is approximately the same diameter of the hanger bore 38. Such a shape enables the body 40 to slide axially into the hanger bore 38. In the illustrated embodiment, a lower section 58 of the body 40 includes a reduce diameter, such that an annular lip 60 is formed about the circumference of the body 40. When the back pressure valve 36 is set in the hanger bore 38, the lip 60 may contact a complementary feature (e.g., an annular lip) in the hanger bore 38. Accordingly, the body 40 can be lowered into the hanger bore 38 until the lip 60 contacts the complementary feature in the hanger bore 38, wherein the lower section 58 and the lip 60 enable proper positioning of the body 40 in the hanger bore 38. In other words, the profile of the body 40 may ensure the back pressure valve 36 is not inadvertently inserted too far axially into the hanger bore 38.

The body seal 42 (e.g., annular seal) is located about the external diameter of the body 40. More particularly, the body seal 42 spans the annular region between the body 40 and the hanger bore 38. In the illustrated embodiment, the body seal 38 is nested in a body seal groove 62 in an external face of the body 40. When installed into the hanger bore 38, the body seal 42 provides a fluid seal between the body 40 and the walls of the hanger bore 38. The body seal 42 may include an elastomeric seal, or the like. For example, in certain embodiments the body seal 42 includes an S-seal or a T-seal.

The body 40 also includes a venting port 64 that extends completely through the body 40 along the axis 57. In operation, the venting port 64 enables fluid to pass through the body 40 as the back pressure valve 36 is installed into the hanger bore 38. Such an arrangement may be advantageous to enable pressure on either side of the back pressure valve 36 to equalize. Equalizing the pressure may enable the back pressure valve 36 to be installed without a significant buildup of pressure that would impart a significantly higher force on one side of the back pressure valve 36, thus, requiring an offsetting force during installation. The venting port 64 is generally closed to regulate (e.g., block) the pressure of the hanger bore 38. For example, the plunger 46 is mated to a sealing surface 66 of the venting port 64. In the illustrated embodiment, the sealing surface 66 includes a chamfer having a profile that is complementary to a profile of the plunger 46. As is discussed in greater detail below, the plunger 46 may be urged axially into a first position that includes mating the plunger 46 against the sealing surface 66 to seal the hanger bore 38 (e.g., a closed position), or may be urged axially to a second position that enables fluid to flow through the venting port 64 (e.g., an open position). The illustrated embodiment depicts the plunger 46 in a closed position.

The plunger 46 is disposed internal to the venting port 64 along the axis 57. The plunger 46 may be urged in either axial direction along the axis 57 between the open and closed positions. As illustrated, the plunger 46 includes a lower stem 68, a sealing head or bell 70, and a stem 72. The lower stem 68 includes a protrusion that extends downward from the bell 70 along the axis 57. The bell 70 includes a shape and profile conducive to mating with the sealing surface 66 of the venting port 64. For example, the bell 70 includes a chamfer 74 that is complementary to the chamfer of the sealing surface 66. Further, the plunger 46 includes a plunger seal 76 (e.g., annular seal) disposed along the face of the chamfer 74 of the bell 70. The plunger seal 76 may include an elastomeric seal in one embodiment. Urging the plunger 46 into the closed position provides a fluid seal between the plunger 46 and the body 40, wherein the fluid seal blocks fluid from passing completely through the venting port 64.

The stem 72 includes a protrusion that extends axially upward from the bell 70 along the axis 57. When the plunger 46 is in the closed position, the stem 72 extends into a cavity 76 of the body 40. For example, the stem 72 extends a height 77 into the cavity 76. Accordingly, the upper stem 72 can be depressed to urge the plunger 46 axially into the open position. Releasing the upper stem 72 enables the plunger 46 to return to the closed position.

The plunger 46 may be biased to the closed position by the spring 48, or similar biasing mechanism. In the illustrated embodiment, the spring 48 is a coil spring that is disposed about the exterior of, and is coaxial with, the stem 68. A first end 78 of the spring 48 is retained at the bell 70 of the plunger 46. A second end 80 of the spring 48 is retained at the bottom hold down ring 44. Accordingly, as the bell 70 is urged axially into the open position (in the direction of the bottom hold down ring 44), the spring 48 is compressed between the bell 70 and the hold down ring 44, thereby generating a restoring force urging the spring 48 and the plunger 46 axially into the closed position as shown in FIG. 2.

The bottom hold down ring 44 includes a plunger passage 82 having a diameter slightly larger than the outer diameter of the lower stem 68 of the plunger 46. Accordingly, the lower stem 68 of the plunger 46 may be passed completely through the plunger passage 82. For example, as the plunger 46 is urged axially into the open position, the lower stem 68 is passed completely through the plunger passage 82 of the bottom hold down ring 44. In the illustrated embodiment, the plunger passage 82 includes a top portion 84 (e.g., a portion proximate the body 40 and having a diameter that is larger the diameter of the spring 48). The second end 80 of the spring 48 may be disposed in the top portion 84 of the plunger passage 82. Such an arrangement is beneficial to hold the plunger 46, spring 48, and the bottom hold down ring 44 relative to one another during assembly of the back pressure valve 36. Further, the bottom hold down ring 44 is mechanically coupled to the body 40. For example, the hold down ring 44 is fastened to the body 40 via fasteners 86 (e.g., bolts) that extend through fastener holes 88 of the bottom hold down ring 44.

The body 40 of the back pressure valve 36 includes the cavity 76. As illustrated, the cavity 76 includes a hollow region in the body 40 that abuts, or is coincident with, the venting port 64. In the illustrated embodiment, the cavity 76 includes a bore extending from a first end 90 of the body 40 toward a second end of the body 92, wherein the second end 92 of the body 40 includes the venting port 64. As discussed previously, the venting port 64 is in communication with the cavity 76 such that the upper stem 72 of the plunger 46 extends axially into the cavity 76. For example, in the closed position, the stem 72 of the plunger 46 extends the height 77 into the cavity 76. In the fully open position, the stem 72 of may be biased axially into the venting port 64, thereby reducing the height 77 the stem extends into the cavity 76. Further, the stem 72 may be translated axially such that the top of the stem 72 is flush with a bottom surface 89 of the cavity 76. In the illustrated embodiment, the hold down sleeve 50 and the lock segments 54 are also disposed in the cavity 76, and are retained by the upper hold down ring 56. The upper hold down ring 56 is threaded onto the first end 90 of the body 40. In another embodiment, the upper hold down ring 56 may be integral with the body 40.

The hold down sleeve 50 includes a body 94 that is moved along (e.g., slid along) the axis 57 to urge the lock segments 54 into a locked position. The hold down sleeve 50 may slide axially along the axis 57 from an unlocked position (e.g., a position wherein the back pressure valve 36 is not locked relative to the hanger bore 38), as illustrated in FIG. 2, to a locked position (e.g., a position wherein the back pressure valve 36 is locked relative to the hanger bore 38), as discussed in further detail below with regard to FIG. 4.

In the illustrated embodiment, the body 94 of the hold down sleeve 50 includes a hollow cylinder having an outer diameter that is less than the internal diameter of the cavity 76, wherein the hold down sleeve 50 may be disposed in the cavity 76. A first end 99 of the body 94 proximate the first end 90 of the back pressure valve 36, also includes sleeve shear pin holes 96. The sleeve shear pin holes 96 extend from the internal diameter of the body 94 to the outer diameter of the body 94. In an unlocked position, the sleeve shear pin holes 96 align with one or more sleeve shear pin holes 98 in the body 40 of the back pressure valve 36. In the unlocked position, the sleeve shear pins 52 may be disposed in the sleeve shear pin holes 96 and 98 to retain the hold down sleeve 50 in the unlocked position. An axial load along the axis 57 can shear the sleeve shear pins 52, thus, enabling the hold down ring 50 to slide axially along the axis 57 from the unlocked position, as illustrated in FIG. 2, to the locked position, as discussed in further detail below with regard to FIG. 4.

The axial load to shear the sleeve shear pins 52 may be delivered via engagement of the hold down sleeve 50 with the tool 28 or other mechanism. For example, in the illustrated embodiment, the body 94 of the hold down sleeve 50 includes a load face 100 that extends about the internal diameter of the hold down sleeve 50. The axial load can be applied to the load face 100. In the illustrated embodiment, the load face 100 includes a flat annular surface that is generally perpendicular to the axis 57. In other embodiments, the load face 100 may include any angle or shape that is conducive to transferring the axial load to the hold down sleeve 50.

A second end 101 of the body 94 (e.g., an end that is proximate the lock segments 54), also includes chamfers 102. The chamfers 102 enable the axial load applied to the hold down sleeve 50 to translate into a radial load that acts on the lock segments 54. For example, in the illustrated embodiment, the second end 101 of the body 94 includes two chamfers 102 about an external diameter of the body 94, wherein the chamfers 102 are complementary to two chamfers 104 on the internal diameter of the lock segments 54. The chamfers 102 and 104 each include an interface having an angle of approximately 45 degrees. Accordingly, the axial load applied to the hold down ring 50 is transmitted to the lock segments 54 as a radial load via the angled interface between the chamfers 102 and 104. In other words, as the hold down ring 50 translates (e.g., moves without rotation or angular displacement) axially in the direction of the lock segments 54, the lock segments 54 are expanded radially into the locked position, as discussed in further detail below with regard to FIG. 4 and arrows 166. In other words, the hold down ring 50 does not rotate, but merely moves in an axial direction to engage and lock the lock segments 54, and, thus, the back pressure valve 36 is seated and locked without rotational motion of the components of the back pressure valve 36 relative to one another, and without rotational motion of the components of the back pressure valve 36 relative to the hanger bore 38.

The lock segments 54 include a profile along their outer diameter that is complementary to a locking groove along the internal diameter of the hanger bore 38. For example, the lock segments 54 include chamfers 106 that enable the lock segments 54 to be centered in a locking groove (e.g., annular groove) of the hanger bore 38. Further, the lock segments include a rib 108 that can engage a rib 109 in the body 40 to ensure the lock segment 54 does not over expand in the radial direction.

The lock segments 54 can include any variety of mechanism that enable the back pressure valve 36 to be retained in a complementary groove of the hanger bore 38. In one embodiment, the lock segments 54 include a plurality of locking dog segments that are biased inward and can be expanded radially. In another embodiment, the lock segments 54 include a C-ring that is biased inward and can be expanded radially.

The back pressure valve 36 also includes a latching mechanism that retains the hold down sleeve 50 and/or the lock segments 54 in the locked position. For example, in the illustrated embodiment, the body 94 of the hold down sleeve 50 includes a latch groove 110 (e.g. annular groove). The latch groove 110 includes a profile that accepts the tip of a spring loaded pin 112 disposed in a hole 114 in the body 40 of the back pressure valve 36. Further, the latch groove 110 and the spring loaded pin 112 are positioned relative to one another such that the spring loaded pin 112 extends into the latch groove 110 when the hold down sleeve 50 is advanced into the locked position. Accordingly, returning the hold down sleeve 50 to the unlocked position may include shearing or otherwise disengaging the spring loaded pin 112.

The body 94 of the hold down sleeve 50 includes an unlock groove 116 that enables a mechanism to extract the hold down ring 50. For example, the unlock groove 116 may be engaged with an axial load in the direction of the first end 90 of the back pressure valve 36. The axial load may shear or otherwise disengage the spring loaded pins 112 from the unlock groove 116. Further, the axial load may enable the hold down sleeve 50 to be moved into the unlocked position, the hold down sleeve 50 to engage the upper hold down ring 56, and the entire back pressure valve 36 to be extracted from the hanger bore 38.

Figure 3:
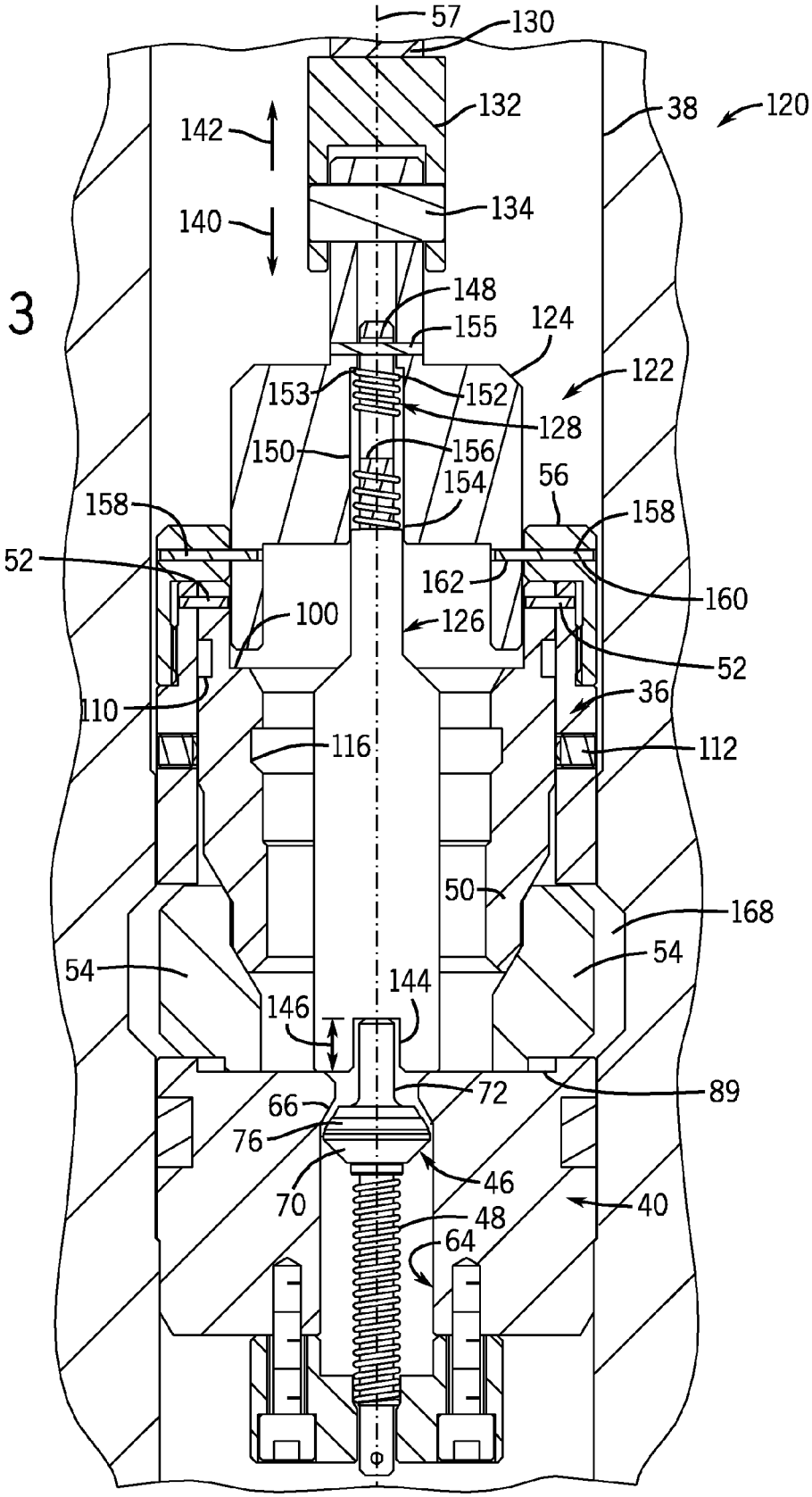
FIG. 3 illustrates an embodiment of the back pressure valve of FIG. 2 and a back pressure valve running tool.

FIG. 3 illustrates a back pressure valve system 120 disposed in the hanger bore 38. The back pressure valve system 120 includes a back pressure valve running tool 122 assembled to the back pressure valve 36. As illustrated, the back pressure valve running tool 122 includes a tool body 124, a running tool plunger 126, a running tool spring 128, a rod 130 and a rod adapter 132.

The running tool 122 is run to and from the hanger bore 38 via the rod 130. For example, the rod 130 may include a tubular member or pipe (e.g., drill pipe) that is suspended from an offshore vessel, or lowered in via a surface device, such as a drilling rig. The rod 130 also provides axial loads parallel to the axis 57. The axial loads may be in a first direction, as indicated by arrow 140, or a second direction, as indicated by arrow 142. In the illustrated embodiment, the rod 130 terminates into the rod adapter 132, and the rod adapter 132 is coupled to the running tool body 124 via a pin 134. Accordingly, an axial load applied to the rod 130 may be transferred to the tool body 124.

The running tool plunger 126 can be employed to depress the plunger 46 of the back pressure valve 36 into the open position. For example, when the running tool 122 is assembled to the back pressure valve 36, the running tool plunger 126 engages the stem 72 of the plunger 46, depressing the plunger 46 axially into an opened position. In other words, the running tool plunger 126 urges the plunger 46 in the first direction (e.g., in the direction of the arrow 140), such that the bell 70 and plunger seal 76 disengage the sealing surface 66 of the body 40, enabling fluid to pass through the venting port 64. In the illustrated embodiment, the tool plunger 126 includes a recess 144 that accepts the stem 72 of the plunger 46. The recess 144 includes a bore into a lower end of the tool plunger 126 that is coaxial with the axis 57. The recess 144 also includes a depth 146 that is less than the height 77 (see FIG. 2) of the stem 72 in the closed position. Thus, the plunger 126 is displaced into the open position by a distance that is approximately equal to the difference between the depth 146 and the height 77. The depth of the recess 144 may be varied to vary the displacement of the plunger 46.

The tool plunger 126 is maintained in contact with the bottom surface 89 of the cavity 76 via the running tool spring 128. In other words, the running tool spring 128 enables the tool plunger to move relative to the tool body 124 such that tool plunger 126 maintains the plunger 46 in the open position as the back pressure valve running tool 122 is moved relative to the back pressure valve 36. For example, in the illustrated embodiment, the running tool spring 128 is disposed about a stem 148 of the tool plunger 126. The stem 148 of the tool plunger 126 is disposed in a plunger bore 150 of the tool body 124, such that a first end 152 of the running tool spring 128 reacts against an end 153 of the plunger bore 150, and a second end 154 of the running tool spring 128 reacts against the tool plunger 126. Thus, as the running tool spring 128 is axially compressed (e.g., the tool body 124 is moved relative to the tool plunger 126), the running tool spring 128 maintains a force on the tool plunger 126 that enables the stem 148 of the tool plunger 126 to slide relative to the tool body 124, and maintain the plunger 46 in the open position. The tool plunger 126 is also coupled to the tool body 124 via a pin 155. The pin 155 is disposed in a slot 156 that runs along the length of the stem 148. Accordingly, the pin 155 travels axially through in the slot 156 as the plunger 126 moves axially relative to the tool body 124.

The back pressure valve running tool 122 is coupled to the back pressure valve 36 via running shear pins 158. The running shear pins 158 extend between the tool body 124 and the retaining ring 56 of the back pressure valve 36. For example, in the illustrated embodiment, the running shear pins 158 extend between a shear pin hole 160 located in the retaining ring 56 and a shear pin hole 162 located in the tool body 124.

The illustrated embodiment of FIG. 3, may be referred to as the running position. In the running position, the back pressure running tool 122 is coupled to the back pressure valve 36 via the running shear pins 158 such that the tool body 124 is suspended above the hold down sleeve 50, the lock segments 54 are inward biased (e.g., they do not extend out in a radial direction from the exterior of the back pressure valve 36), and the tool plunger 126 biases the plunger 46 into the open position. The back pressure valve system 120 may be maintained in the running position (e.g., unlocked and open) as the back pressure valve is landed into the hanger bore 38. The back pressure valve system 120 may be subsequently locked and closed to properly install the back pressure valve 36.

Figure 4:
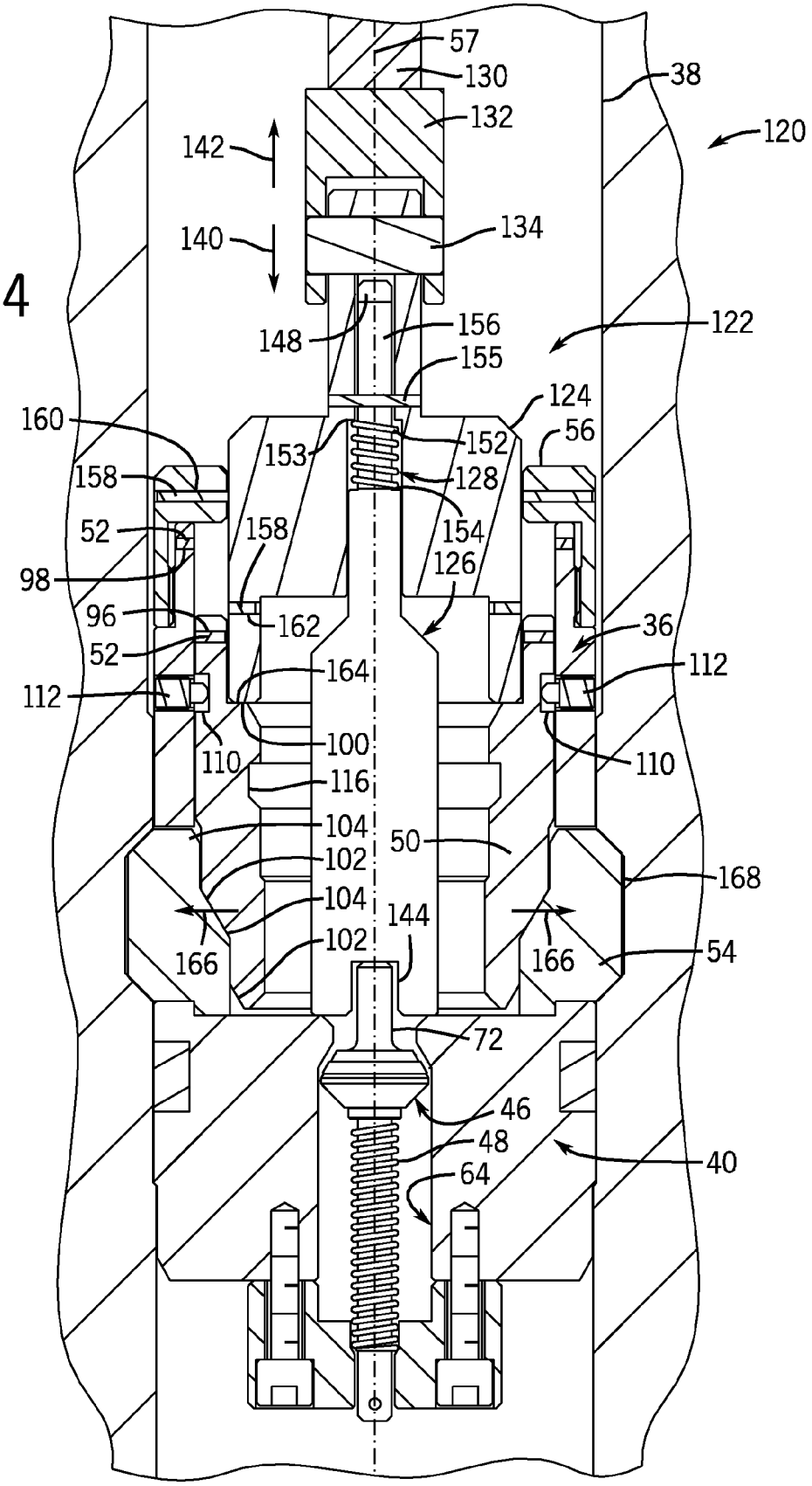
FIG. 4 illustrates an embodiment of the back pressure valve and the back pressure valve running tool of FIG. 3 in a locked position.

FIG. 4 illustrates an embodiment of the back pressure valve system 120 in a locked and open position, wherein the back pressure running tool 122 has not been removed. The back pressure valve 36 is locked via an axial load in the first direction (e.g., in the direction of the arrow 140). For example, an axial load in the first direction and applied to the rod 130 is transmitted to the tool body 124 via the rod adapter 132. The axial load acting on the tool body 124 shears the running shear pins 158 at the interface between shear pin holes 160 and 162. The tool body 124 is, then, lowered into engagement with the load face 100. For example, a lower face 164 of the tool body 124 engages the load face 100. The axial load is, then, transferred to the sleeve shear pins 52 via the hold down sleeve 50. The axial load shears the sleeve shear pins 52, enabling the hold down sleeve 50 to slide into engagement with the lock segments 54. The interface of the chamfers 102 of the hold down sleeve 50 and the chamfers 104 of the hold translates the axial load into a radial load that urges the lock segment 54 in an outward radial direction (e.g., in the direction of arrows 166). The hold down sleeve 50 is advanced in the first direction (e.g., the direction of the arrow 140), until the lock segments 54 engage a locking groove 168 of the hanger bore 38. Further, the spring loaded pins 112 snap radially into engagement with the latch groove 110. In the illustrated embodiment, the back pressure valve 36 is in the locked position, however, the tool plunger 126 maintains the plunger 46 in the open position.

Figure 5:
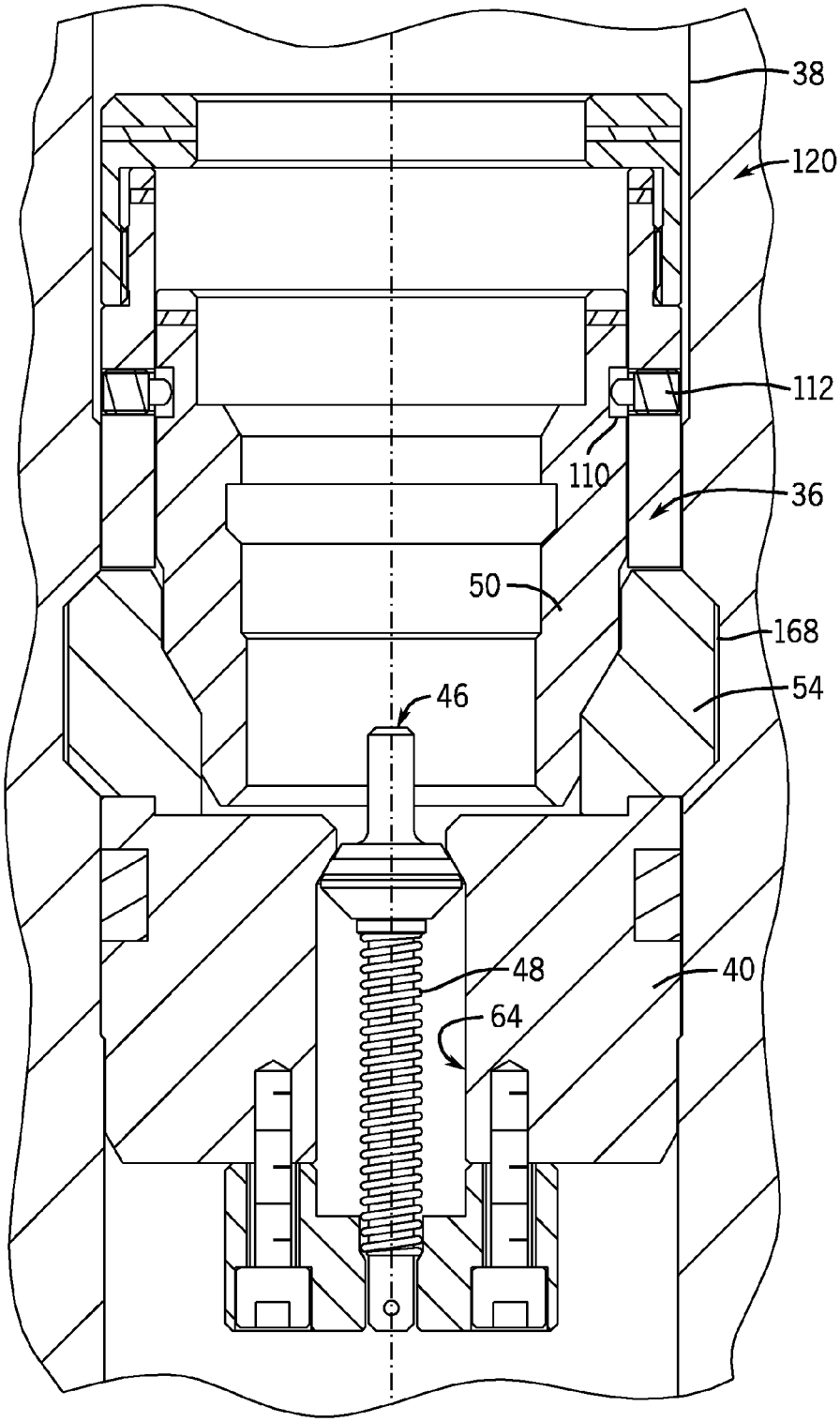
FIG. 5 illustrates an embodiment of the back pressure valve in a locked position.

The back pressure valve tool 122 may be extracted from the back pressure valve system 120, enabling the back pressure valve 36 to remain in the locked position and the plunger 46 to return to the closed position. For example, an axial load applied to the rod 130 in the second direction (e.g., the direction of the arrow 142), extracts the back pressure valve running tool 122, including the tool body 124 and the tool plunger 126, away from the back pressure valve 36 and the hanger bore 36. FIG. 5 illustrates an embodiment of the back pressure valve 36 in the locked and closed position. The lock segments 54 are in engagement with the locking groove 168 of the hanger bore 38, the spring loaded pins 112 are engaged into the latch groove 110, the plunger 46 is biased to the closed position by the spring 48, and the back pressure valve tool 122 has been completely extracted from the hanger bore 38. In this position, the back pressure valve 36 prevents pressures in the hanger bore 38 from manifesting up (e.g., in the second direction) through the hanger bore 38.

Figure 6:
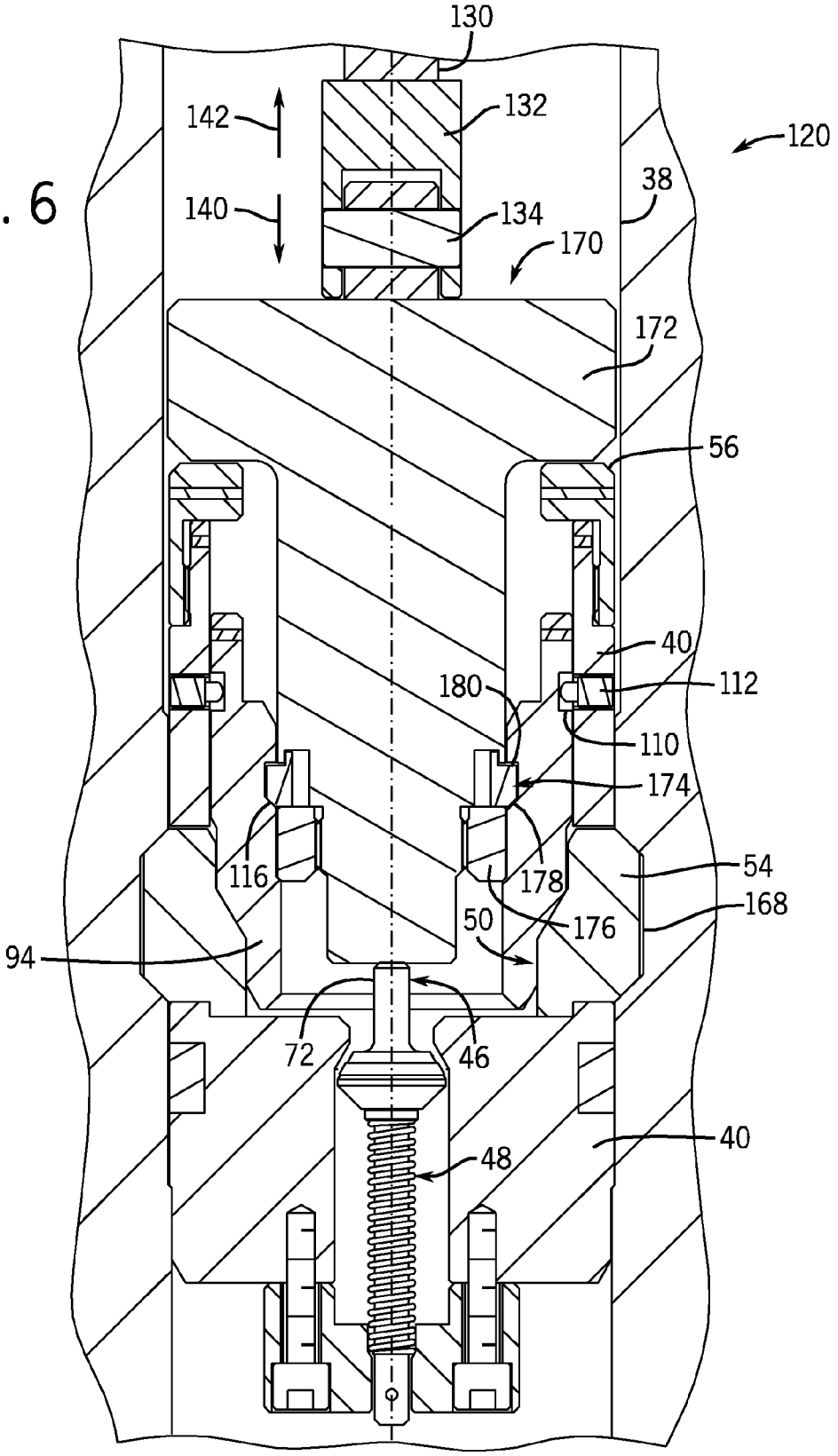
FIG. 6 illustrates an embodiment of the back pressure valve and a back pressure valve retrieval tool.

FIG. 6 illustrates an embodiment of the back pressure valve system 120 that includes a back pressure valve retrieval tool 170. The back pressure valve retrieval tool 170 is employed to unlock, open and/or extract the back pressure valve 36 from the hanger bore 38. The back pressure retrieval tool 170 includes a retrieval tool body 172, a snap ring 174, and a snap ring retainer 176. The snap ring retainer 176 is coupled to the retrieval tool body 172 to secure the snap ring 174 to the retrieval tool body 172. The retrieval tool 170 is coupled to the rod 130 via the rod adapter 132. Similar to previously discussed embodiments, the rod 130 terminates into the rod adapter 132, and the rod adapter 132 is coupled to the retrieval tool body 124 via the pin 134. Accordingly, an axial load applied on the rod 130 is transferred to the tool body 124.

The snap ring 174 may be employed to engage the unlock groove 116 of the hold down ring 50. For example, in the illustrated embodiment, the snap ring 174 includes an outward biased C-ring that includes a chamfer 178 and a load face 180. The chamfer 178 is shaped such that as the retrieval tool 170 is lowered axially into the cavity 76 of the back pressure valve 36, the internal edges of the hold down sleeve 50 engage the chamfers 178 causing the outward biased snap ring 174 to contract inward (e.g., in a radial direction toward the retrieval tool body 172). The snap ring 174 remains contracted until the snap ring 174 aligns with the unlock groove 116. Once aligned with the unlock groove 116, the snap ring 174 expands radically into the outward biased position, engaging the unlock groove 116.

An axial load applied to the retrieval tool 170 in the second direction (e.g., the direction of the arrow 142) is transmitted to the unlock groove 116 via the load face 180 of the snap ring 174. As mentioned previously, applying the axial load to the unlock groove 116 in the second direction enables extraction of the back pressure valve 36. For example, the axial load in the second direction 142 shears or otherwise disengages the spring loaded pins 112 from the latch groove 110, thus, enabling the hold down sleeve 50 to slide axially into the unlocked position. The lock segments 54, then, contract radially inward out of the locking groove 168. Once, unlocked, the axial load in the second direction 142 continues to be applied, such that the body 94 of the hold down sleeve 50 engages the upper hold down ring 56. Continuing to apply the axial load extracts the entire back pressure valve 36 from the hanger bore 38. It is also noted that when retrieval tool 170 is installed into the cavity 76, the retrieval tool body 172 engages and depresses the stem 72 of the plunger 46, and forces the plunger 46 to the opened position, thereby, equalizing pressure across the back pressure valve 36.

Figure 7:
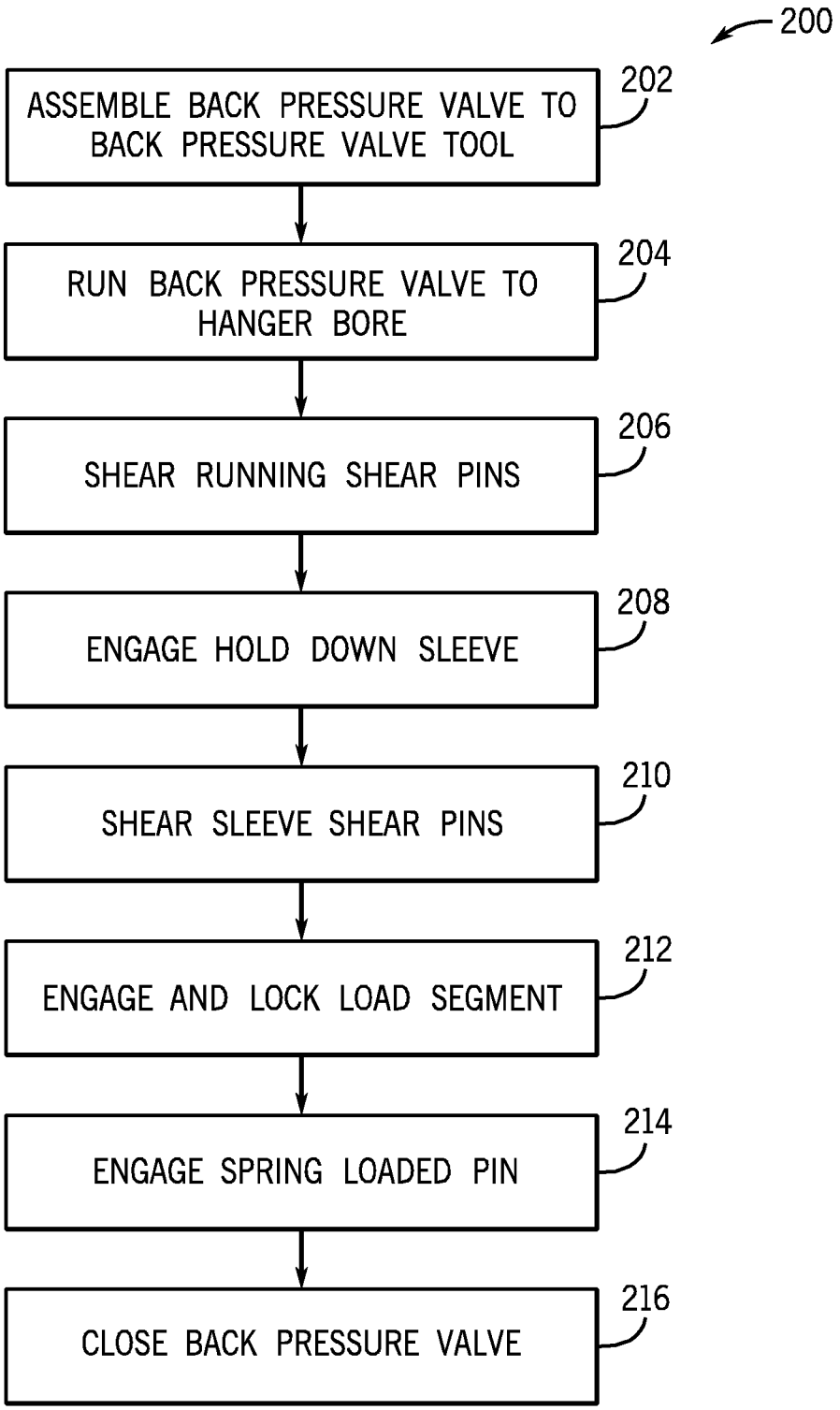
FIG. 7 is a flowchart that illustrates an exemplary method of installing the back pressure valve.

FIG. 7 is a flowchart that illustrates a method 200 of installing the back pressure valve 36 in accordance with previously discussed embodiments. The method 200 includes assembling the back pressure valve 36 to the back pressure valve running tool 122, as depicted at block 202. For example, the back pressure valve 36 may be assembled to the back pressure valve running tool 122 via insertion of the running shear pins 158 into the shear pin hole 160 located in retaining ring 56 and the shear pin hole 162 located in the tool body 124.

The method 200 also includes running the back pressure valve 36 to the hanger bore 38, as depicted at block 204. In one embodiment, this may include running the back pressure valve 36 to the wellhead 12 and the hanger bore 38 via the rod 130.

The method 200 includes shearing the running shear pins 158, as depicted at block 206. As discussed above, shearing the running shear pins 158 may include applying an axial load in a first direction. For example, an axial load applied via the rod 130 is transmitted to the tool body 124 via the rod adapter 132, and shears the running shear pins 158.

The method 200 includes engaging the hold down sleeve 50, as depicted at block 208. For example, the lower face 164 of the tool body 124 engages the load face 100, transferring the axial load to the sleeve shear pins 52 via the hold down sleeve 50. The axial load shears the sleeve shear pins 52, as depicted at block 210, enabling the hold down sleeve 50 to slide into engagement with the loading segments 54, locking the lock segments in place, as depicted at block 212.

The method 200 also includes engaging the spring loaded pin 112, as depicted at block 214. For example, the hold down sleeve 50 is advanced in the first direction (e.g., the direction of the arrow 140) until the lock segments 54 engage a locking groove 168 of the hanger bore 38 and the spring loaded pins 112 snap into engagement with the latch groove 110. As discussed previously, the spring loaded pins 112 may engage the latch ring 110 of the hold down sleeve 50 to block the lock down sleeve 50 from backing out and, thus, maintain the lock segments 54 and the back pressure valve 36 in the locked position.

The method 200 also includes closing the back pressure valve 36, as depicted at block 216. For example, once the back pressure valve 36 is locked, the back pressure valve running tool 124 may be retrieved, enabling the plunger 46 to return to the closed position. For example, an axial load applied to the rod 130 in the second direction (e.g., the direction of the arrow 142), extracts the back pressure valve running tool 122, including the tool body 124 and the tool plunger 126, from the back pressure valve 36. As discussed previously, the back pressure valve 36 remains in the locked position and the plunger 46 is returned to the closed position.

Figure 8:
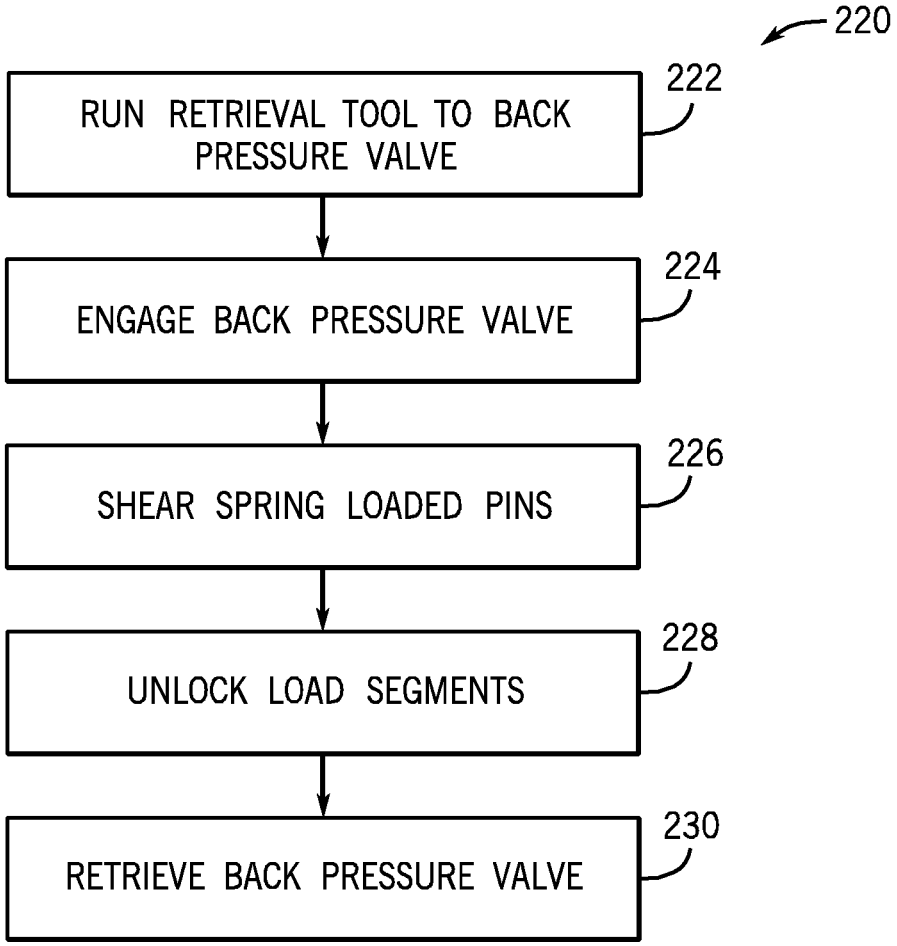
FIG. 8 is a flowchart that illustrates an exemplary method of extracting the back pressure valve.

FIG. 8 is a flowchart that illustrates a method 220 of retrieving the back pressure valve 36 in accordance with previously discussed embodiments. The method 220 includes running the back pressure valve retrieval tool 170 to the back pressure valve 36 installed in the hanger bore 36, as depicted at block 222. Further, the method 220 includes engaging the back pressure valve 36 with the back pressure valve retrieval tool 170, as depicted at block 224. For example, the retrieval tool body 172 is lowered into the cavity 76 with an axial load in the first direction until the retrieval tool body 172 engages the stem 72 of the plunger 46, opening the back pressure valve 36, and the snap ring 174 engages the unlock groove 116. The method 220 also includes shearing the spring loaded pins 112, as depicted at block 226. For example, an axial load is applied in the second direction, wherein the axial load urges the hold down sleeve 50 in the second direction, causing the spring loaded pins 112 to shear or otherwise disengage the latch groove 110. As the hold down sleeve 50 is advanced in the second direction, the chamfers 102 of the hold down sleeve 50 disengage the chamfers 104 of the lock segments 54, unlocking the lock segments, as depicted at block 228. Further, the movement of the retrieval tool body 172 in the second direction may disengage the stem 72 of the plunger 46, enabling the back pressure valve 36 to return to a closed position. It should be noted that returning to the closed position does not create a significant change in the force to extract the back pressure valve 36 because pressure across the valve 36 is equalized when the back pressure valve 36 was previously opened. With the back pressure valve 36 unlocked, the back pressure valve 36 is retrieved via the back pressure valve running tool 170, as depicted at block 230.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a flow control device, comprising:

a body;

an actuator coupled to the body, wherein the actuator has a first path of travel in an axial direction along an axis of the body between a first axial position and a second axial position;

a radial lock coupled to the body, wherein the radial lock has a second path of travel in a radial direction between a radial unlocked position and a radial locked position in response to movement of the actuator along the first path of travel, the radial unlocked position is recessed relative to an outermost circumference of the body, the radial locked position protrudes relative to the outermost circumference of the body;

a tool interface configured to engage with a retrievable tool to drive the actuator along the axial path of travel; and at least one shear structure configured to shear in response to the retrievable tool to enable movement of the actuator along the first path of travel.

2. The system of claim 1, wherein the at least one shear structure comprises one or more shear pins.

3. The system of claim 1, wherein the at least one shear structure comprises one or more spring loaded pins.

4. The system of claim 1, wherein the at least one shear structure comprises at least one retainer configured to hold a position of the actuator prior to shearing in response to the retrievable tool.

5. The system of claim 1, wherein the at least one shear structure comprises a first shear structure configured to hold the actuator in the first axial position with the radial lock disposed in the radial unlocked position.

6. The system of claim 1, wherein the at least one shear structure comprises a second shear structure configured to hold the actuator in the second axial position with the radial lock disposed in the radial locked position.

7. The system of claim 1, wherein the at least one shear structure comprises first and second shear structures that are axially offset from one another relative to the axis of the body.

8. The system of claim 1, wherein the actuator is configured to move along the first path of travel between a first axial abutment and a second axial abutment.

9. The system of claim 8, comprising a hold down ring coupled to the body, wherein the first axial abutment is disposed on the hold down ring and the second axial abutment is disposed on the body.

10. The system of claim 1, wherein the actuator comprises a hold down sleeve.

11. The system of claim 1, wherein the actuator comprises a first taper configured to engage a first mating taper on the radial lock.

12. The system of claim 1, comprising a fluid passage through the flow control device, and a valve disposed in the fluid passage.

13. The system of claim 12, wherein the valve comprises a plunger biased toward a closed position.

14. The system of claim 13, wherein the plunger is configured to be held in an open position by the retrievable tool.

15. The system of claim 1, wherein the flow control device is configured to seat in a bore and lock in the bore via the radial lock in response to a first axial force in a single first direction delivered via the retrievable tool, wherein the retrievable tool is configured to be retrieved from the bore after seating and locking the flow control device in the bore.

16. The system of claim 15, comprising the retrievable tool configured to couple to the flow control device and configured to transmit the first axial force in the single first direction.

17. A system, comprising:

a flow control device tool configured to removably couple to and separate from a flow control device having a body, an actuator, a radial lock, a tool interface, and at least one shear structure, wherein the actuator has a first path of travel in an axial direction along an axis of the body between a first axial position and a second axial position, the radial lock has a second path of travel in a radial direction between a radial unlocked position and a radial locked position in response to movement of the actuator along the first path of travel, the radial unlocked position has the radial lock recessed relative to an outermost circumference of the body, the radial locked position has the radial lock protruding relative to the outermost circumference of the body, and the at least one shear structure is configured to shear in response to the flow control device tool to enable movement of the actuator along the first path of travel, wherein the flow control device tool is configured to move through a bore without the flow control device when the radial lock is in the radial locked position against a portion of the bore.

18. The system of claim 17, wherein the flow control device tool is configured to transmit a first axial force in a single first direction to seat the flow control device in a bore and lock the flow control device in the bore via the radial lock after shearing a first shear structure of the at least one shear structure, or the flow control device tool is configured to transmit a second axial force in a single second direction to unlock the flow control device from the bore via the radial lock and unseat the flow control device from the bore after shearing a second shear structure of the at least one shear structure, or a combination thereof.

19. The system of claim 17, wherein the flow control device tool comprises a tool body and a running tool plunger, the tool body is configured to engage the tool interface of the flow control device, and the running tool plunger is configured to hold a spring loaded plunger of the flow control device in an open plunger position during installation or removal of the flow control device in a bore.

20. The system of claim 17, wherein the radial locked position of the radial lock protrudes beyond a radially outermost width of the flow control device and the flow control device tool.

21. A system, comprising:

a flow control device, comprising:

an actuator having a first path of travel between a first position and a second position;

a radial lock having a second path of travel in a radial direction between a radial unlocked position and a radial locked position in response to movement of the actuator along the first path of travel;

a tool interface configured to removably couple with and separate from a tool, wherein the tool is configured to move through a bore without the flow control device when the radial lock is in the radial locked position against a portion of the bore; and at least one retainer configured to hold the actuator in the first or second position, wherein the at least one retainer comprises a shear structure configured to shear in response to a first load to enable movement of the actuator along the first path of travel, or a spring loaded structure configured to shear or disengage in response to a second load to enable movement of the actuator along the first path of travel, or a combination thereof.

22. The system of claim 21, wherein the radial locked position of the radial lock protrudes beyond a radially outermost width of the flow control device and the tool.

* * * * *